US011279168B1

(12) United States Patent
Yeung

(10) Patent No.: US 11,279,168 B1
(45) Date of Patent: Mar. 22, 2022

(54) STENCIL KIT

(71) Applicant: Sharon Shum Long Yeung, Vancouver (CA)

(72) Inventor: Sharon Shum Long Yeung, Vancouver (CA)

(73) Assignee: Sharon Shum Long Yeung, BC (CA)

( * ) Notice: Subject to any disclaimer, the term of this patent is extended or adjusted under 35 U.S.C. 154(b) by 0 days.

(21) Appl. No.: 17/131,556

(22) Filed: Dec. 22, 2020

(51) Int. Cl.
*B44D 2/00* (2006.01)

(52) U.S. Cl.
CPC ..... *B44D 2/007* (2013.01)

(58) Field of Classification Search
CPC . B41F 15/04; B41F 15/34; B41N 1/24; B41N 1/248; B44D 2/002; B44D 2/007; B05C 17/06
USPC ..... 101/115, 127
See application file for complete search history.

(56) References Cited

U.S. PATENT DOCUMENTS 8,590,448 B2 * 11/2013 Swisher ..... B05C 17/06 101/127
9,597,909 B2 3/2017 Myska
10,513,135 B1 * 12/2019 Gessner ..... B41K 3/44

OTHER PUBLICATIONS

Simon Says Stencils, retrieved from <https://www.simonsaysstamp.com/brand/Simon-Says-Stencils> on Mar. 5, 2021.
Turnabout™ Stamp Set, retrieved from <https://concordand9th.com/collections/turnabouts/products/birdie-talk-turnabout-bundle> on Mar. 5, 2021.
Turnabout™ Stencil Pack, retrieved from <https://concordand9th.com/collections/turnabouts/products/faceted-turnabout-stencil-pack> on Mar. 5, 2021.
Wreath Building Template, retrieved from <https://ginakdesigns.com/product/wreath-builder-templates/?sscid=a1k4_9da40&v=3e8d115eb4b3> on Mar. 5, 2021.

* cited by examiner

*Primary Examiner* — Matthew G Marini
*Assistant Examiner* — Marissa Ferguson-Samreth
(74) *Attorney, Agent, or Firm* — Jeff Sun; McCarthy Tétrault LLP

(57) ABSTRACT

A stencil kit comprises a stencil base, one or more canvas positioners, and one or more guide rings. The stencil base has a circular shaped cut-out region and one or more sets of scales spaced circumferentially around the cut-out region. Each canvas positioner has an opening adapted to receive the canvas. Each guide ring has a radial array of guide lines spaced circumferentially around the guide ring. A user may use the stencil kit with stencils that are included in the stencil kit and/or stencils that are provided separately to make patterns on a canvas.

20 Claims, 16 Drawing Sheets

STENCIL KIT

TECHNICAL FIELD

The present invention relates generally to arts and crafts stencils, and in particular to a stencil kit which enables a user (e.g. an artist, a lay person, a child, etc.) to make patterns and/or designs on a canvas (e.g. a paper, cardstock, etc.). The present invention also relates to methods of using the stencil kit to make patterns and/or designs.

BACKGROUND

Stencils are commonly used for creating decorative designs or patterns on the surface of a substrate such as clothing, paper and cardstock. Stencils are typically formed by cutting out portions of a rigid sheet of material (e.g. cardboard, plastics, etc.) to obtain a physical negative of the design desired to be reproduced. A design can be reproduced on the surface of a substrate by placing the stencil on top of the surface and applying paint, ink or other types of pigment over the stencil to impress the design onto the surface.

Most stencils that are available in the market are square or rectangular shaped. These stencils are limited to producing a single image (i.e. the image that is pre-cut on the stencil) and may need to be used together with other stencils (i.e. stencils having a different pre-cut image) or other tools if one wishes to create more elaborate designs. For example, one typically needs to use multiple stencils if one wishes to create overlapping patterns. As another example, one typically needs to apply masking techniques (e.g. by masking out parts of the stencil during the inking process) if one wishes to apply different colors over different cut-out portions of the stencil.

Using multiple stencils can be complicated and can require some skill. Since each stencil is capable of reproducing only a portion of the design, the stencils may need to be applied in a specific sequence and/or precisely aligned or oriented to create the entire design. Applying masking techniques can be time consuming and laborious. For example, some masking techniques require the user to cover certain parts of a stencil with removable tape during the inking process and to reposition the tape multiple times during multiple rounds of inking to create a multicolored design.

There is a need for easy to use and inexpensive tools that enable a user (e.g. a crafter, a lay person or a child) to create more elaborate designs using stencils. There is also a need for tools that enable a user to create multicolored designs without the need to apply masking techniques. There is also a need for tools that enable a user to create multiple different designs or images using the same stencil.

The foregoing examples of the related art and limitations related thereto are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tools, kits and methods which are meant to be exemplary and illustrative, not limiting in scope. In various embodiments, one or more of the above-described problems have been reduced or eliminated, while other embodiments are directed to other improvements.

One aspect of the invention relates to a stencil kit that enables a user to make patterns on a canvas. The stencil kit comprises a stencil base having a circular shaped cut-out region, one or more circular shaped canvas positioners having an opening, and one or more guide rings. The stencil base has one or more sets of scales spaced circumferentially around the cut-out region. Each guide ring has a radial array of guide lines spaced circumferentially around the guide ring at angular intervals corresponding to angular intervals formed between the scales of the stencil base. Each canvas positioner may be inserted into the cut-out region to guide the user to position the canvas in a desired location within the cut-out region. Each guide ring may be inserted into the cut-out region to define an inking region for receiving a circular shaped stencil when the guide ring is inserted in the cut-out region.

In some embodiments, the stencil kit includes one or more circular shaped stencils. These circular shaped stencils may comprise a marker located at their circumferential edge. The user may align the marker with the scales when the stencil is inserted in the inking region to orient the stencil in desired orientations within the inking region.

In some embodiments, the stencil base comprises four sets of scales and each set of scales is spaced circumferentially around the cut-out region at a radial distance that is different from the other sets of scales. The scales that form a set may be evenly spaced around the cut-out region. The first set of scales may comprise eight evenly spaced first scales. The second set of scales may comprise twelve evenly spaced second scales. The third set of scales may comprise sixteen evenly spaced third scales. The fourth set of scales may comprise twenty-four evenly spaced fourth scales. Scales from different sets may be depicted by different symbols. In some embodiments, scales from different sets are aligned radially at the 12 o'clock, 3 o'clock, 6 o'clock and 9 o'clock positions of the stencil base.

In some embodiments, the guide rings have an outer diameter that is the same as the diameter of the circular shaped cut-out region. The outer diameter of the guide rings may be in the range of 10" to 12". The guide rings may each have a different inner diameter for receiving different sized stencils.

In some embodiments, the canvas positioners have an outer diameter that is the same as the diameter of the circular shaped cut-out region. The outer diameter of the canvas positioners may be in the range of 10" to 12". The canvas positioners may each have a different sized opening for receiving different sized canvases. The opening of the canvas positioners may be square or rectangular shaped.

In some embodiments, the stencil base, the canvas positioners, and the guide rings are made of polyethylene terephthalate glycol. The stencil base may be made of transparent polyethylene terephthalate glycol and the scales may be printed on a back surface of the stencil base over a white background. Similarly, the guide rings may be made of transparent polyethylene terephthalate glycol and the radial array of guidelines may be printed on a back surface of guide rings over a white background.

Another aspect of the invention relates to a method of using the stencil kit described herein. The method comprises placing the stencil base on a work surface followed by inserting a canvas positioner in the cut-out region of the stencil base. A canvas is placed in the opening of the canvas positioner and on the work surface. The canvas positioner is removed afterwards. Next, a guide ring is inserted in the cut-out region to define an inking region within the cut-out region. A stencil is then placed in the inking region and on top of at least part of the canvas. Optionally, the stencil may be coupled to the guide ring. The stencil or the guide ring and stencil coupled thereto are rotated to a desired orientation by referencing the scales of the stencil base. After rotating the stencil to a desired orientation, ink is applied through stencil to create a pattern on the canvas.

In some embodiments, the method comprises repeating the steps of rotating the stencil to a desired orientation by referencing the scales and applying ink through the stencil to create a desired pattern on the canvas. In some embodiments, the stencil is formed by cutting out a portion of a card stock using a coordinating die of a stamp. In some embodiments, ink is applied through the stencil by using the stamp to imprint the pattern through the stencil.

Another aspect of the invention relates to another method of using the stencil kit described herein. The method comprises placing the stencil base on a work surface followed by inserting a canvas positioner in the cut-out region. A canvas is inserted in the opening and on the work surface. The canvas positioner is removed afterwards. Next, a rectangular shaped stencil is coupled to the canvas positioner or another canvas positioner. This canvas positioner and the rectangular shaped stencil coupled thereto are placed in the cut-out region to thereby position the rectangular shaped stencil on top of at least part of the canvas. The canvas positioner and stencil coupled thereto are rotated to a desired orientation by referencing the scales of the stencil base. After rotating the stencil to a desired orientation, ink is applied through stencil to create a pattern on the canvas.

In accordance with aspects of the invention, stencil kit described herein allows a user to build multi-colored wreaths with a single stencil and without the need for tracking or masking, and without the need to clean the stencil during the whole process.

In addition to the exemplary aspects and embodiments described above, further aspects and embodiments will become apparent by reference to the drawings and by study of the following detailed descriptions.

BRIEF DESCRIPTION OF THE DRAWINGS

Exemplary embodiments are illustrated in referenced figures of the drawings. It is intended that the embodiments and figures disclosed herein are to be considered illustrative rather than restrictive.

DETAILED DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

One aspect of the invention provides a stencil kit comprising various tools that may be used together with a stencil to enable a user (e.g. an artist, a lay person, a child, etc.) to easily create elaborate and/or multicolored designs on a canvas. Unless context dictates otherwise, the term "stencil" (as used herein) refers to a thin sheet of material (e.g. cardboard, metal, plastics, polymeric materials, etc.) with patterns or designs cut out of the sheet. Unless context dictates otherwise, the term "canvas" (as used herein) refers to the surface of a substrate such as paper, cloth, cardstock, or the like. In accordance with aspects of the invention, the stencil kit described herein may be adapted for use with either square or rectangular shaped stencils that are available in the market or customized circular shaped stencils that may be included as part of the stencil kit or provided separately from the stencil kit.

Figure 1:
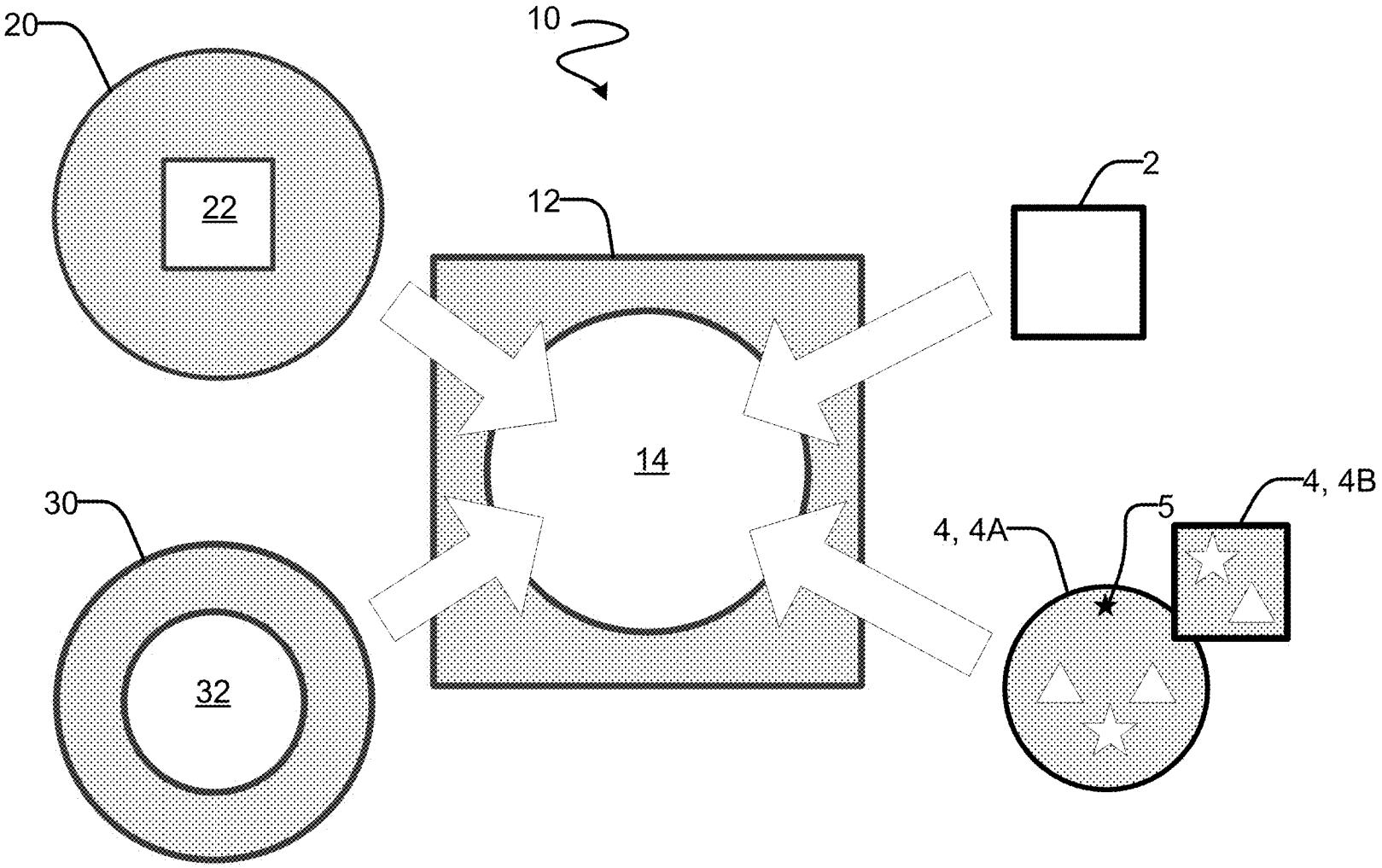
FIG. 1 schematically shows a stencil kit according to an example embodiment of the invention.

FIG. 1 shows a stencil kit 10 according to an example embodiment of the invention. Stencil kit 10 comprises a stencil base 12 having a cut-out region 14. Stencil kit 10 may include one or more canvas positioners 20 that may be removably inserted in cut-out region 14. When canvas positioner 20 is inserted in cut-out region 14, canvas positioner 20 may act as a guide to help a user position canvas 2 (e.g. a piece of paper, a cardstock, or the like) in a desired location and/or orient canvas 2 in a desired orientation within cut-out region 14. Stencil kit 10 may also include one or more guide rings 30 that may be removably inserted in cut-out region 14. Guide ring 30 is typically inserted in cut-out region 14 after canvas 2 has been positioned at a desired location and/or oriented in a desired orientation in cut-out region 14. Guide ring 30 is designed to fit into cut-out region 14 to define an inking region 32 (i.e. a region for receiving ink through a stencil 4) within cut-out region 14 when guide ring 30 is inserted in cut-out region 14.

Stencil base 12, canvas positioners 20 and/or guide rings 30 may be made of materials such as lightweight plastic, Polyethylene Terephthalate Glycol (PETG), or the like. These materials are durable, flexible and pliable. These materials can also provide strong resistance to impact. Stencil base 12, canvas positioners 20 and/or guide rings 30 are typically about 0.5 mm to about 3 mm thick (including any thickness value therebetween, e.g. 1 mm, 1.5 mm, 2 mm or 2.5 mm) although thicknesses outside of this range are possible.

Stencil kit 10 may be used with stencils 4 to create distinctly designed stencil patterns on canvas 2 (e.g. by repeating the steps of applying ink over stencil 4 onto canvas 2 and rotating stencil 4 at regular angular turning intervals). Stencil kit 10 may be used with customized stencils 4A (e.g. stencils that have a circular perimeter) and/or stencils 4B that are available in the market (e.g. stencils that have a square or rectangular perimeter) as discussed in more detail elsewhere herein. In some embodiments, stencil kit 10 includes one or more customized stencils 4A.

Figure 2:
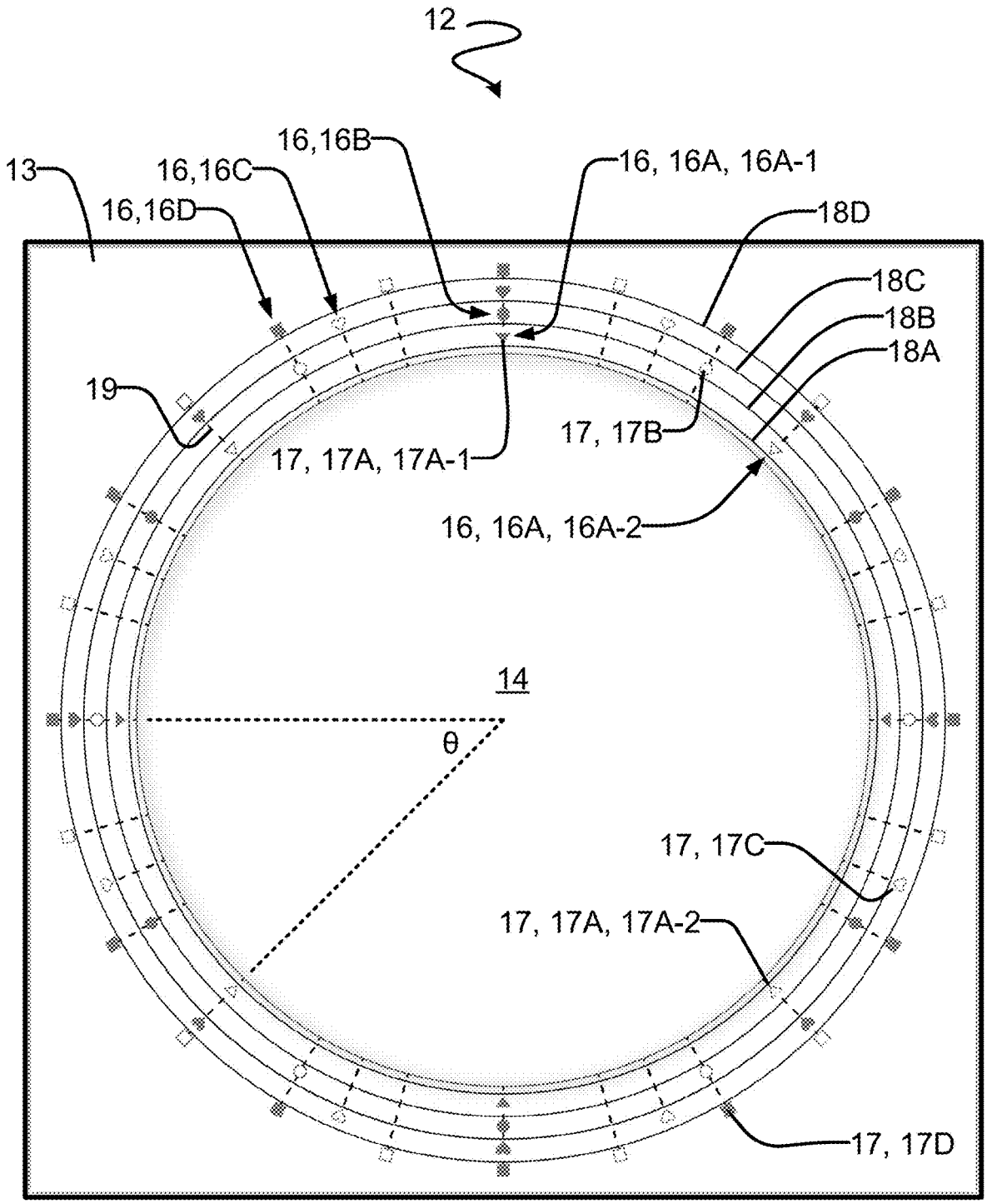
FIG. 2 is a plan view of an example embodiment of a stencil base that may be included in the FIG. 1 stencil kit.
Figure 2A:
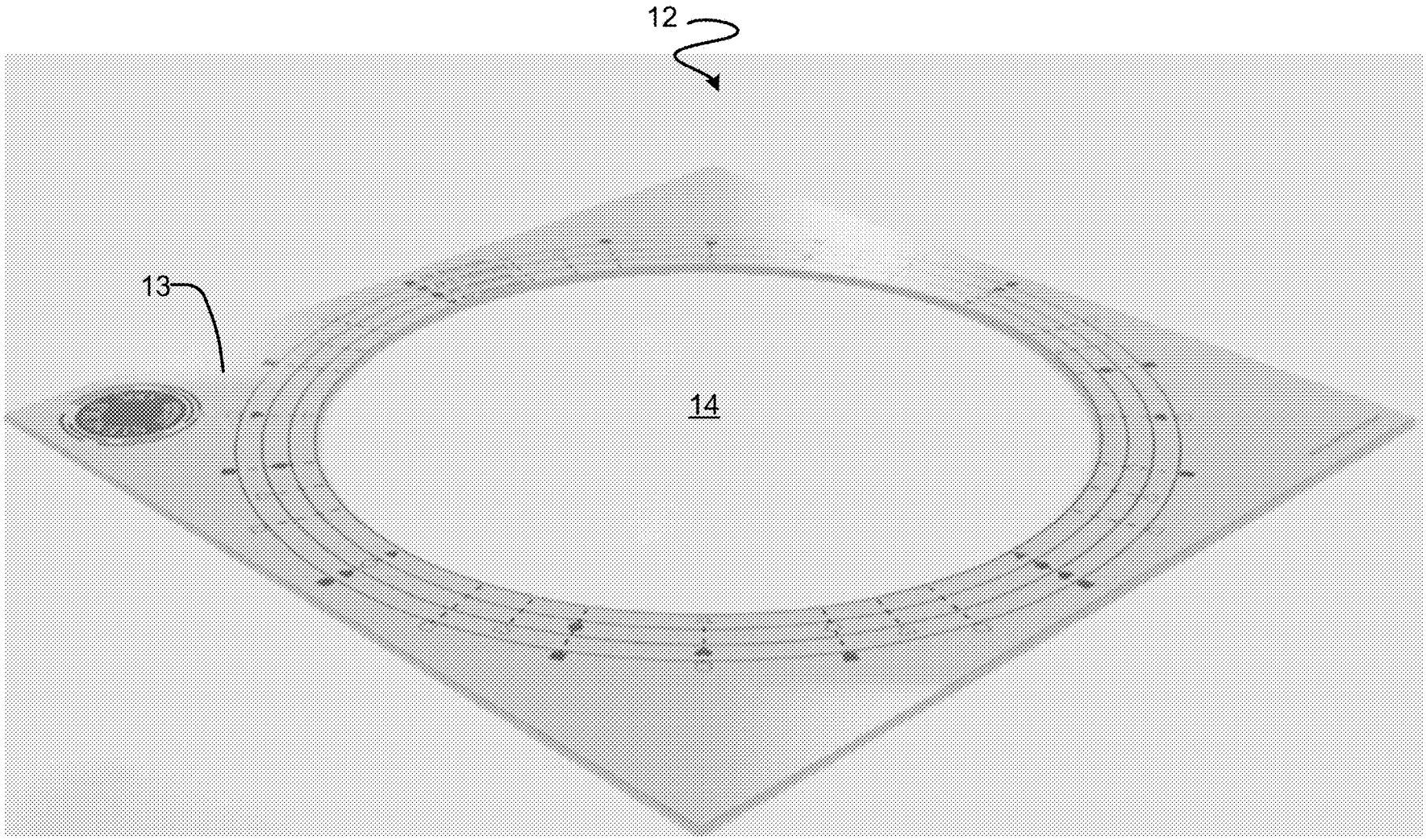
FIG. 2A is a perspective view of the FIG. 2 stencil base.

FIG. 2 is a plan view of an example embodiment of stencil base 12. As shown in FIG. 2, stencil base 12 comprises a frame 13 having a circular shaped cut-out region 14 and one or more sets 16 of scales 17 spaced circumferentially around cut-out region 14. Frame 13 may be squared shaped (i.e. frame 13 may have a square perimeter). Frame 13 may have a perimeter that is typically in the range of about 48" to about 64". Cut-out region 14 may have a diameter that is typically in the range of about 10" to 12".

The one or more sets 16 of scales 17 may be printed directly on a front surface of frame 13 or, preferably, on a back surface of frame 13. That is, frame 13 may be made of a transparent material and the one or more sets 16 of scales 17 may be printed on the back surface (instead of on the front surface) of frame 13 and, optionally, over a white background. This can improve the visibility of scales 17 and prevent the scales 17 from coming off of stencil base 12 due to wear and tear on the front surface of stencil base 12.

Each set 16 of scales 17 may include distinctive visual identifiers and/or may be located at distinctive spatial locations on stencil base 12 to help a user identify scales 17 belonging to a set 16. For example, each of the scales 17 that form a set 16 may be located at the same radial distance away from the center of cut-out region 14 as shown in FIG. 2. Scales 17 from different sets 16 may be located at different radial distances away from the center of cut-out region 14. As another example, each of the scales 17 that form a set 16 may be depicted by the same symbol (e.g. a circle, a square, etc.) as shown in FIG. 2. Scales 17 from different sets 16 may be depicted by different symbols.

In some embodiments, each set 16 of scales 17 is provided to define a specific turning interval (e.g. 15°, 22.5°, 30°, 45°, etc.) that may be conveniently referenced by a user when the user is using stencil kit 10. For example, a user may reference the scales 17 from a set 16 and rotate stencil 4 (which is inserted in the cut-out region 14) by the turning interval corresponding to the set 16 (e.g. by aligning a marker of stencil 4 with different scales 17 from a set 16 each time stencil 4 is rotated).

In accordance with aspects of the invention, the scales 17 of stencil base 12 enables a user to create elaborate and/or multicolored designs on canvas 2 by repeating the steps of rotating stencil 4 to a desired angle or orientation followed up applying ink over stencil 4 onto canvas 2. Scales 17 enable any user (e.g. a crafter, a layer person, etc.) to consistently and precisely rotate stencil 4 to a desired orientation or angle by rotating stencil 4 until a marker of stencil 4 is aligned with a scale 17. Since scales 17 from a set 16 are marked at locations that define a specific turning interval, a user may rotate stencil 4 by a desired turning interval by rotating stencil 4 between adjacent scales 17 from the same set 16.

To aid in visualization stencil base 12 may optionally comprise one or more rings 18 corresponding to the one or more sets 16 of scales 17 (i.e. stencil base 12 may include a ring 18 for each set 16 of scales 17). Rings 18 may be printed directly on the front surface of frame 13 or, preferably, on the back surface of frame 13. Each set 16 of scales 17 may be marked on a corresponding ring 18 as shown in FIG. 2. Each of the rings 18 has a different radius compared to the other rings 18. Each of the rings 18 is concentric with cut-out region 14.

Stencil base 12 may also optionally include one or more lines 19 (e.g. dotted lines as shown in FIG. 2) coupled to scales 17 and extending radially toward the center of cut-out region 14 to aid in visualization. In some embodiments, each scale 17 is coupled to a line 19. In some embodiments, some of lines 19 may be coupled to two or more scales 17 (i.e. scales 17 from different sets 16).

Stencil base 12 may comprise any number (e.g. 1, 2, 3, 4, 5, 6, 7, 8, 9 or 10) of sets 16 of scales 17 and, optionally, any corresponding number of rings 18. In the example embodiment shown in FIG. 2, stencil base 12 comprises four sets 16A, 16B, 16C, 16D of scales 17. The first set 16A includes first scales 17A (depicted by triangle scales in FIG. 2) marked on and circumferentially spaced around first ring 18A. The second set 16B includes second scales 17B (depicted by circle scales in FIG. 2) marked on and circumferentially spaced around second ring 18B. The third set 16C includes third scales 17C (depicted by heart-shaped scales in FIG. 2) marked on and circumferentially spaced around third ring 18C. The fourth set 16D includes fourth scales 17D (depicted by square scales in FIG. 2) marked on and circumferentially spaced around fourth ring 18D. Since each set 16 of scales 17 defines a specific turning interval, the number of sets 16 of scales 17 may be selected or otherwise customized (e.g. during production of stencil base 12) based on the number of turning intervals desired to be provided.

As shown in FIG. 2, scales 17 that form a set 16 may be spaced evenly around the circumference of cut-out region 14 to form a fixed angle A (i.e. an angle between notional lines extending from the center of cut-out region 14 to scales 17) between adjacent scales 17 in a set 16. Each set 16 may include a different number of scales 17. For example, first set 16A shown in FIG. 2 includes eight of first scales 17A spaced evenly around the circumference of cut-out region 14 to define an angle A of about 45° between adjacent first scales 17A. As another example, second set 16B shown in FIG. 2 includes twelve of second scales 17B spaced evenly around the circumference of cut-out region 14 to form an angle A of about 30° between adjacent second scales 17B. As another example, third set 16C shown in FIG. 2 includes sixteen of third scales 17C spaced evenly around the circumference of cut-out region 14 to form an angle A of about 22.5° between adjacent third scales 17C. As another example, fourth set 16D shown in FIG. 2 includes twenty-four of fourth scales 17D spaced evenly around the circumference of cut-out region 14 to form an angle A of about 15° between adjacent fourth scales 17D. Each set 16 may include any number of scales 17 spaced around the circumference of cut-out region 14.

In a currently preferred embodiment, scales 17 that form a set 16 are spaced evenly around the circumference of cut-out region 14. In these embodiments, the number of scales 17 in a set 16 defines the turning interval provide by the set 16 so the number of sets 16 of scales 17 may be selected or otherwise customized (e.g. during production of stencil kit 10) based on the number of turning intervals desired to be provided.

In some embodiments, scales 17 from different sets 16 are radially aligned with each other at one or more specific locations around cut-out region 14. For example, stencil base 12 may comprise four sets 16A, 16B, 16C, 16D of scales 17, and scales 17 from all of the different sets 16A, 16B, 16C, 16D may be radially aligned at the 12 o'clock, 3 o'clock, 6 o'clock, and 9 o'clock positions as shown in FIG. 2. In some embodiments, scales 17 from some of the different sets 16 (e.g. sets 16A, 16B, 16C, 16D) may be radially aligned with each other at one or more specific locations around cut-out region 14. For example, scales 17 from second set 16B and fourth set 16D may be radially aligned at the 1 o'clock, 2 o'clock, 4 o'clock, 5 o'clock, 7 o'clock, 8 o'clock, 10 o'clock and 11 o'clock positions as shown in FIG. 2.

In some embodiments, some sets 16 of scales 17 may include two or more subsets 16-1, 16-2. For example, first set 16A of scales 17A may include a first subset 16A-1 of scales 17A-1 and a second subset 16A-2 of scales 17A-2 as shown in FIG. 2. In the example embodiment shown in FIG. 2, first subset 16A-1 of scales 17A-1 and second subset 16A-2 of scales 17A-2 are located at the same radial distance away from the center of cut-out region 14, but are depicted by symbols with different shading to distinguish first subset scales 17A-1 from second subset scales 17A-2 (i.e. first subset scales 17A-1 are depicted with solid triangles whereas second subset scales 17A-2 are depicted with hollow triangles). The first subset scales 17A-1 and the second subset scales 17A-2 are spaced circumferentially around cut-out region 14 and interlaced with each other. That is, each subset 16A-1, 16A-2 defines the same turning interval (e.g. first subset 16A-1 and second subset 16A-2 both define 90° turning intervals) but the subsets 16A-1, 16A-2 are offset from each other (e.g. first subset 16A-1 starts at the 12 o'clock position whereas second subset 16A-2 starts at a position between the 1 o'clock and 2 o'clock positions).

Advantageously, the subsets can help a user keep track of which rotation they are on during stenciling to avoid the need to clean stencil 4 after every turn (to avoid color contamination) if the user wishes to apply alternating colors through the stencil pattern after each rotation. That is, the subsets allow a user to apply a first color through stencil 4 by making reference to a first subset, clean the stencil once, and subsequently apply a second color through stencil 4 by making reference to a second subset.

Figure 6A:
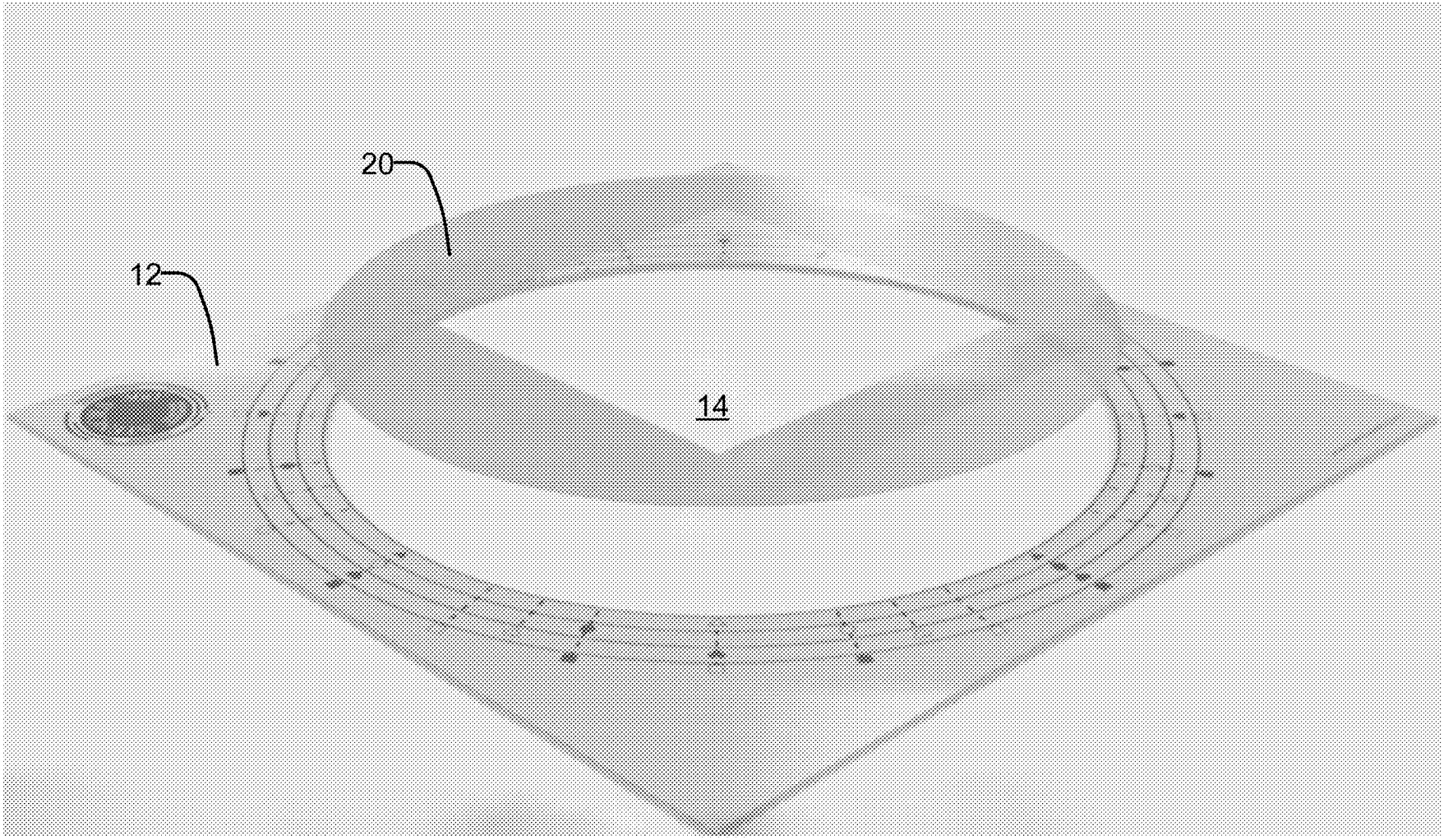
FIGS. 6A-G are perspective views that show various parts of the FIG. 1 stencil kit.
Figure 6B:
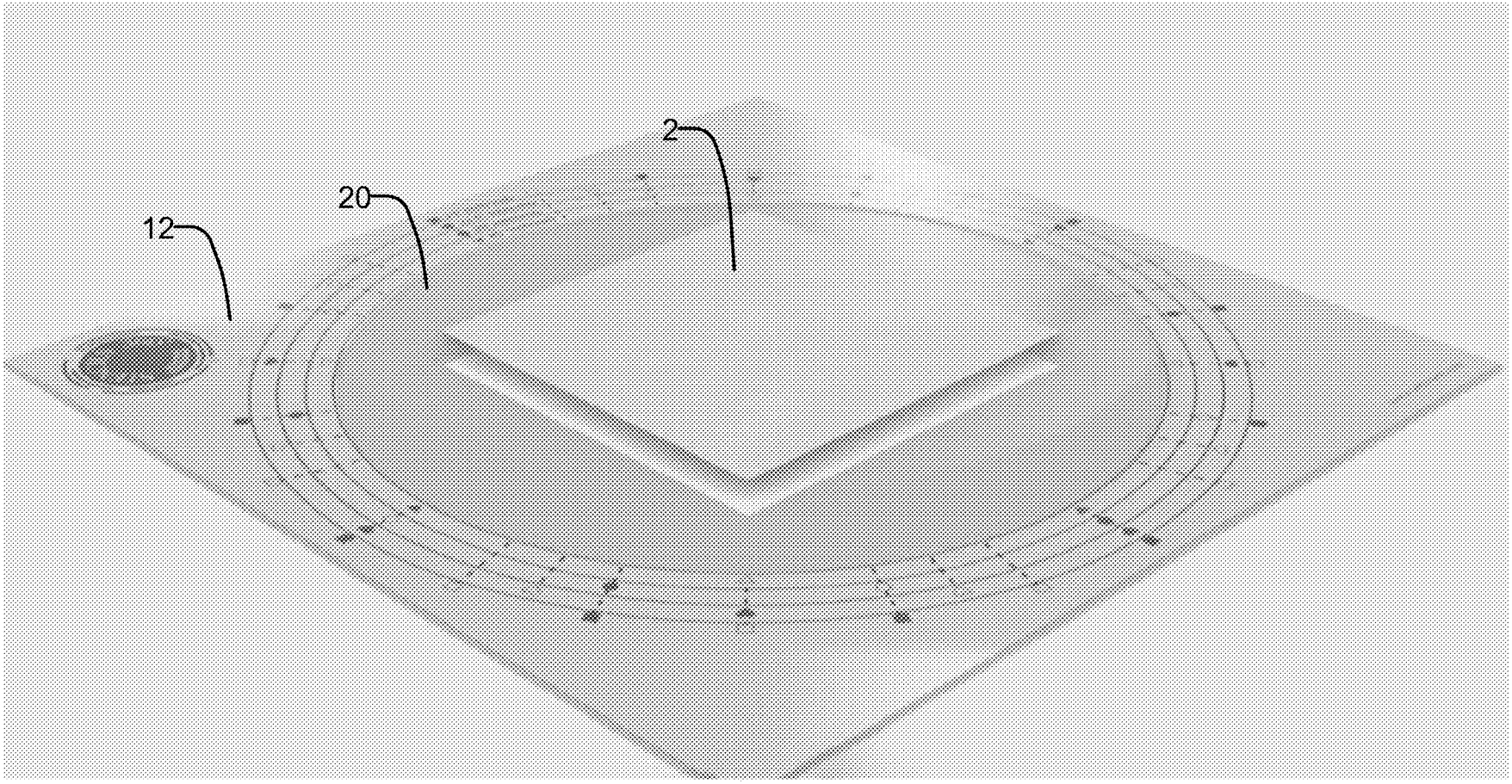
Figure 6C:
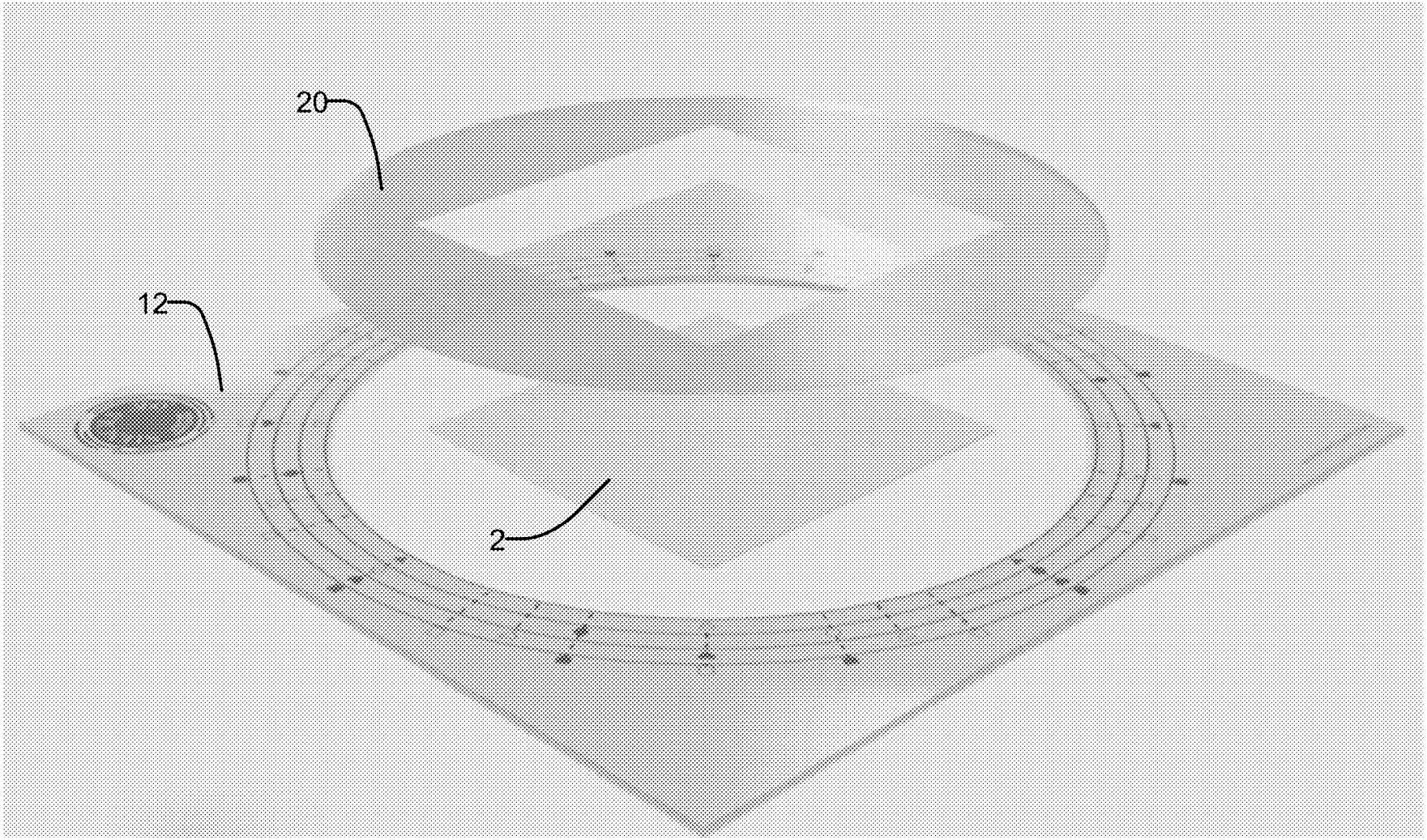

FIGS. 3A-F show canvas positioners 20 of various sizes that may be included in stencil kit 10. Canvas positioner 20 is typically circular shaped. Canvas positioner 20 may have a circumference that is the same as the circumference of cut-out region 14 of stencil base 12. Canvas positioner 20 may be removably inserted in cut-out region 14 (e.g. see FIG. 6A). Canvas positioner 20 has a body and an opening 22 adapted to receive canvas 2 when canvas positioner 20 is inserted in cut-out region 14 (e.g. see FIG. 6B). Canvas positioner 20 allows a user to precisely position canvas 2 in a desired location within cut-out region 14 by inserting canvas 2 in opening 22 and subsequently removing canvas positioner 20 from cut-out region 14 (e.g. see FIG. 6C). Opening 22 may be located at the center of canvas positioner 20 as shown in FIGS. 3A-F although this is not necessary.

Figure 3A:
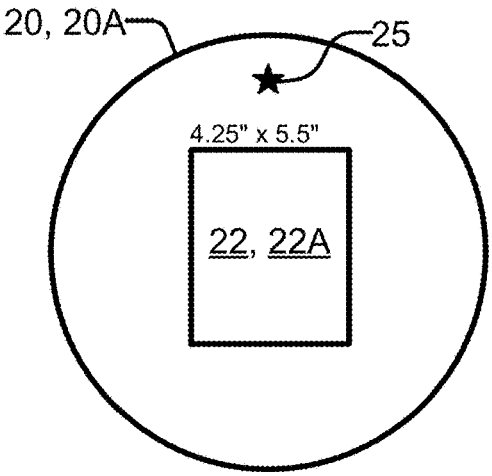
FIGS. 3A-F show various example canvas positioners that may be included in the FIG. 1 stencil kit.
Figure 3B:
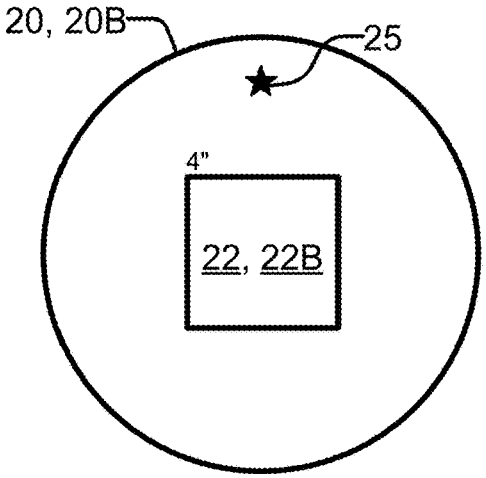
Figure 3C:
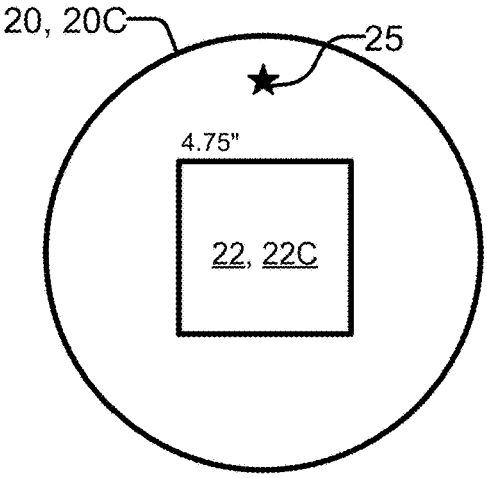
Figure 3D:
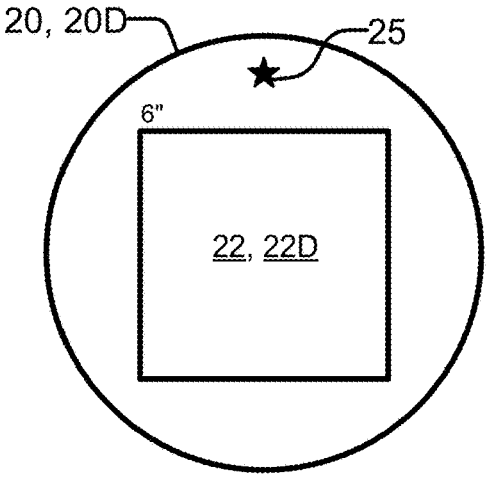
Figure 3E:
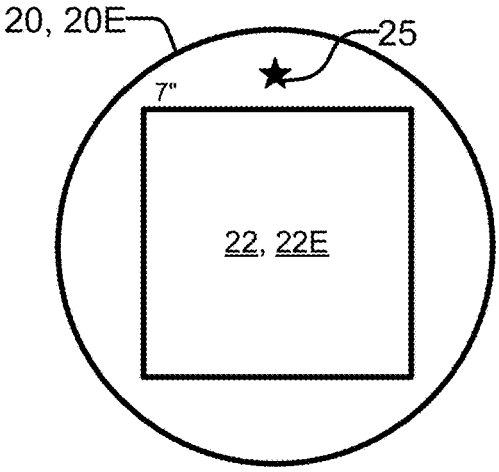
Figure 3F:
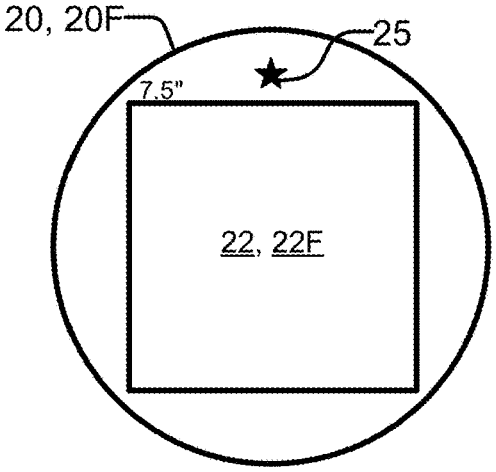

Stencil kit 10 typically includes one or more canvas positioners 20. Each canvas positioner 20 may have a different sized opening 22 (compared to the other canvas positioners 20 included in stencil kit 10) to receive different sized canvases 2. Although not necessary, stencil kit 10 typically includes canvas positioners 20 that have a square or rectangular shaped opening 22 to receive a square or rectangular shaped canvas 2. The size of openings 22 may correspond to common card sizes. For example, stencil kit 10 may include a first canvas positioner 20A having a 4¼' by 5½" opening 22A as shown in FIG. 3A, a second canvas positioner 20B having a 4" by 4" opening 22B as shown in FIG. 3B, a third canvas positioner 20C having a 4¾" by 4¾" opening 22C as shown in FIG. 3C, a fourth canvas positioner 20D having a 6" by 6" opening 22D as shown in FIG. 3D, a fifth canvas positioner 20E having a 7" by 7" opening 22E as shown in FIG. 3E, and a sixth canvas positioner 20F having a 7½" by 7½" opening 22F as shown in FIG. 3F. The size of openings 22 may be labeled directly on canvas positioners 20 as shown in FIGS. 3A-F. Stencil kit 10 may include any number (e.g. 1, 2, 3, 4, 5, 6, 7, 8, 9 or 10) of canvas positioners 20.

In some embodiments, canvas positioner 20 includes a marker 25 printed or otherwise marked directly on canvas positioner 20. Although not necessary, marker 25 is typically located near the circumferential edge of canvas positioner 20 as shown in FIGS. 3A-F. Marker 25 may be included to provide a visual indicia for a user's reference to help the user orient canvas positioner 20 in a desired orientation within cut-out region 14. For example, a user may orient canvas positioner 20 in a desired orientation by inserting canvas positioner 20 in cut-out region 14 and rotating canvas positioner 20 to align marker 25 with a scale 17. Once canvas positioner 20 is oriented in a desired orientation, a user may place canvas 2 in opening 22 and subsequently remove canvas positioner 20 from cut-out region 14. This allows canvas 2 to be precisely oriented and/or positioned within cut-out region 14 for stenciling.

Figure 4A:
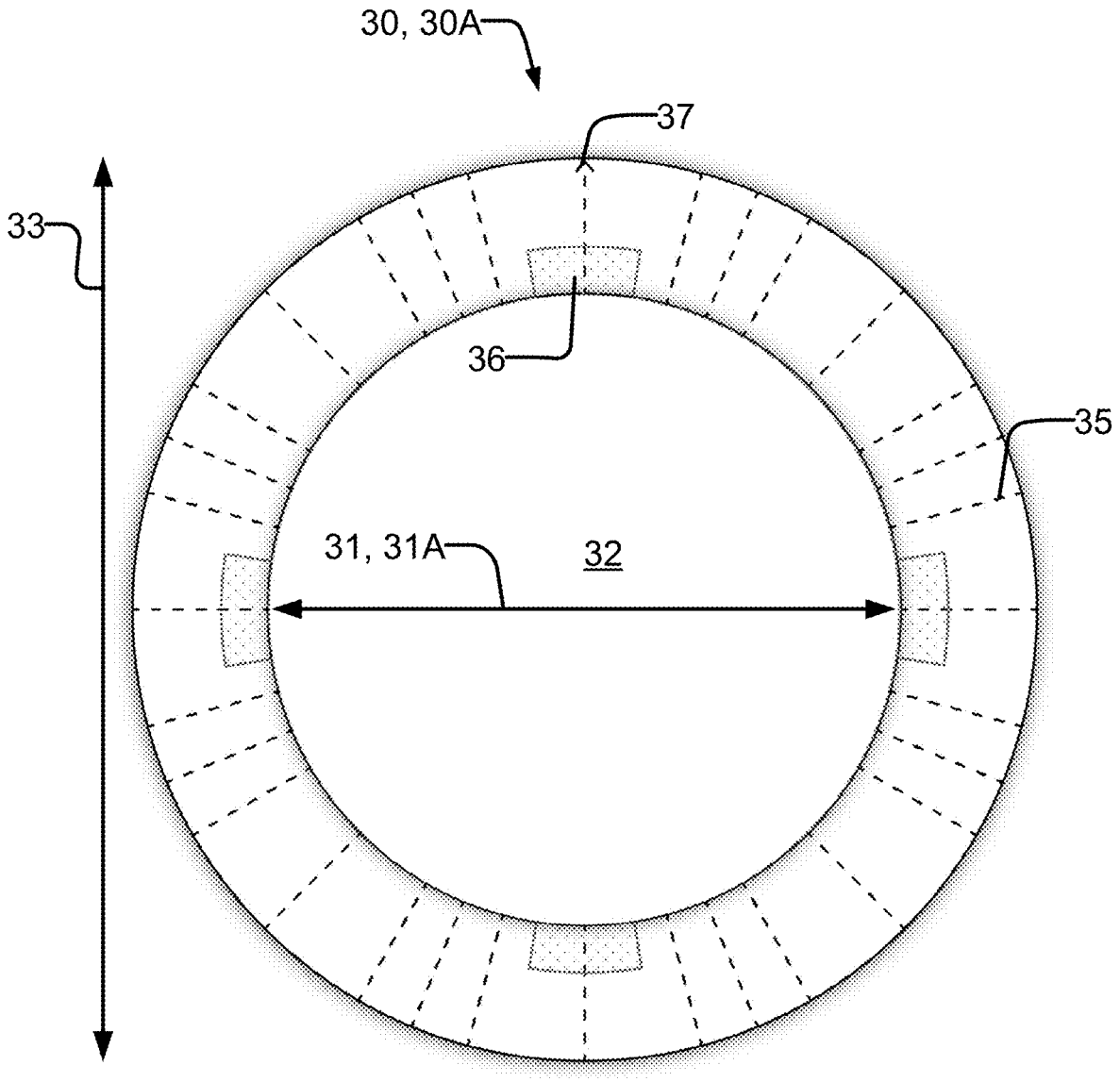
FIGS. 4A-C show various example guide rings that may be included in the FIG. 1 stencil kit.
Figure 4B:
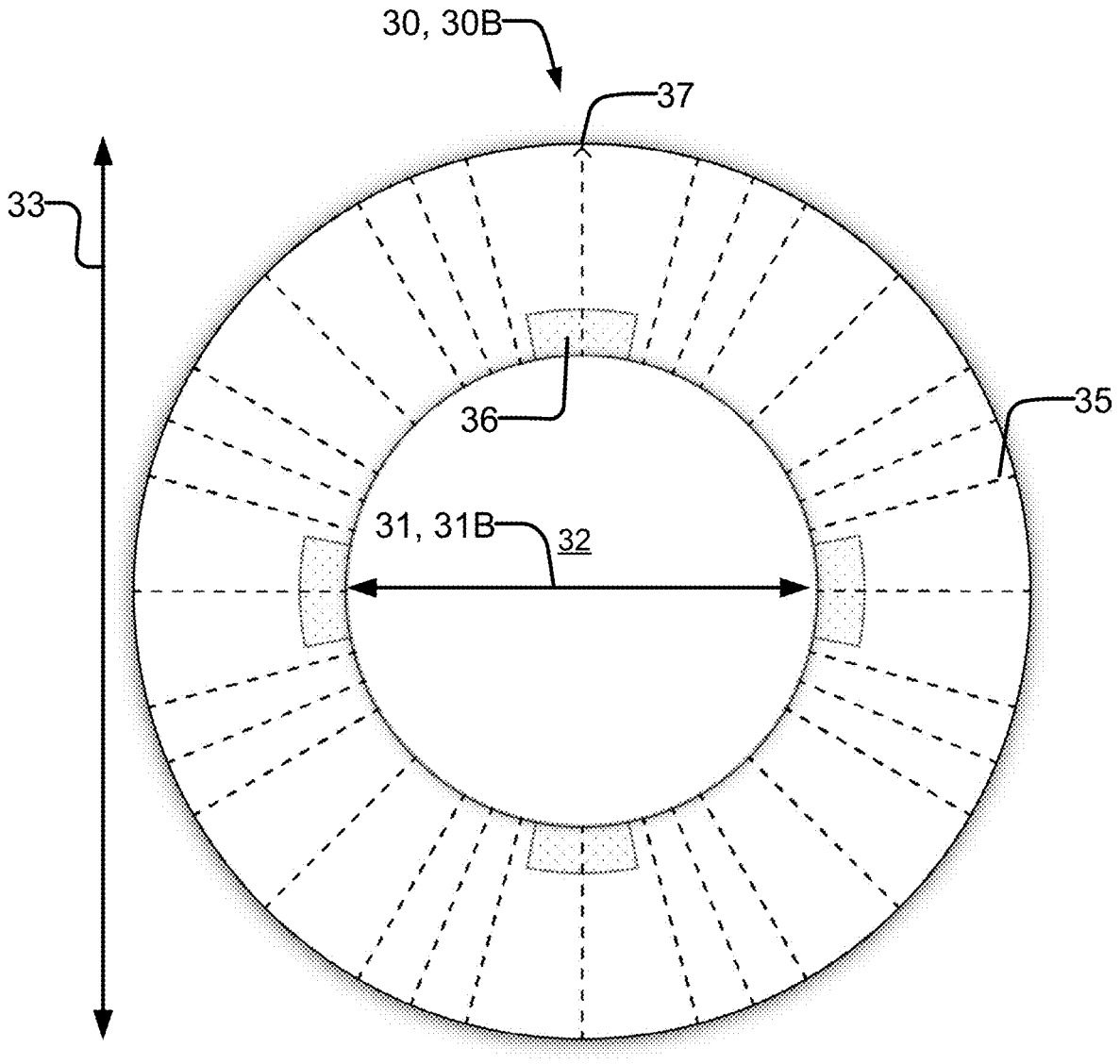
Figure 4C:
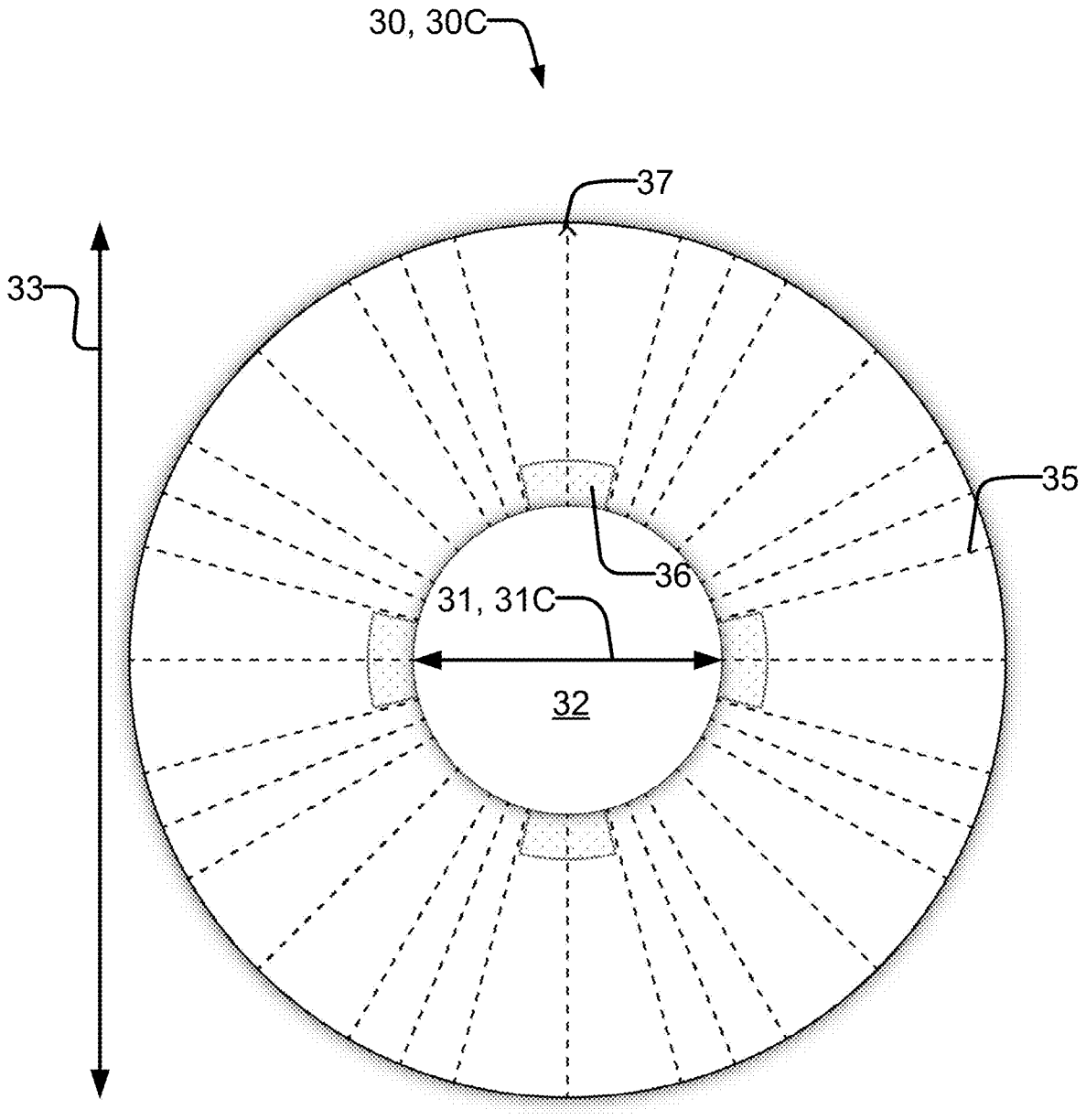

FIGS. 4A-C show various example guide rings 30 that may be included in stencil kit 10. Guide ring 30 has a ring-shaped body that defines a circular shaped inking region 32 (i.e. the region that receives stencil 4). Although not necessary, guide ring 30 may have an inner diameter 31 that is in the range of 3" to 9" (e.g. including any value therebetween such as 4", 5", 6", 7" or 8"). Although not necessary, guide ring 30 may have an outer diameter 31 that is in the range of about 10" to 12" (e.g. including any value therebetween such as 10.5", 11" or 11.5"). Outer diameter 33 is typically about the same length or slightly shorter than the diameter of cut-out region 14 of stencil base 12.

Figure 6D:
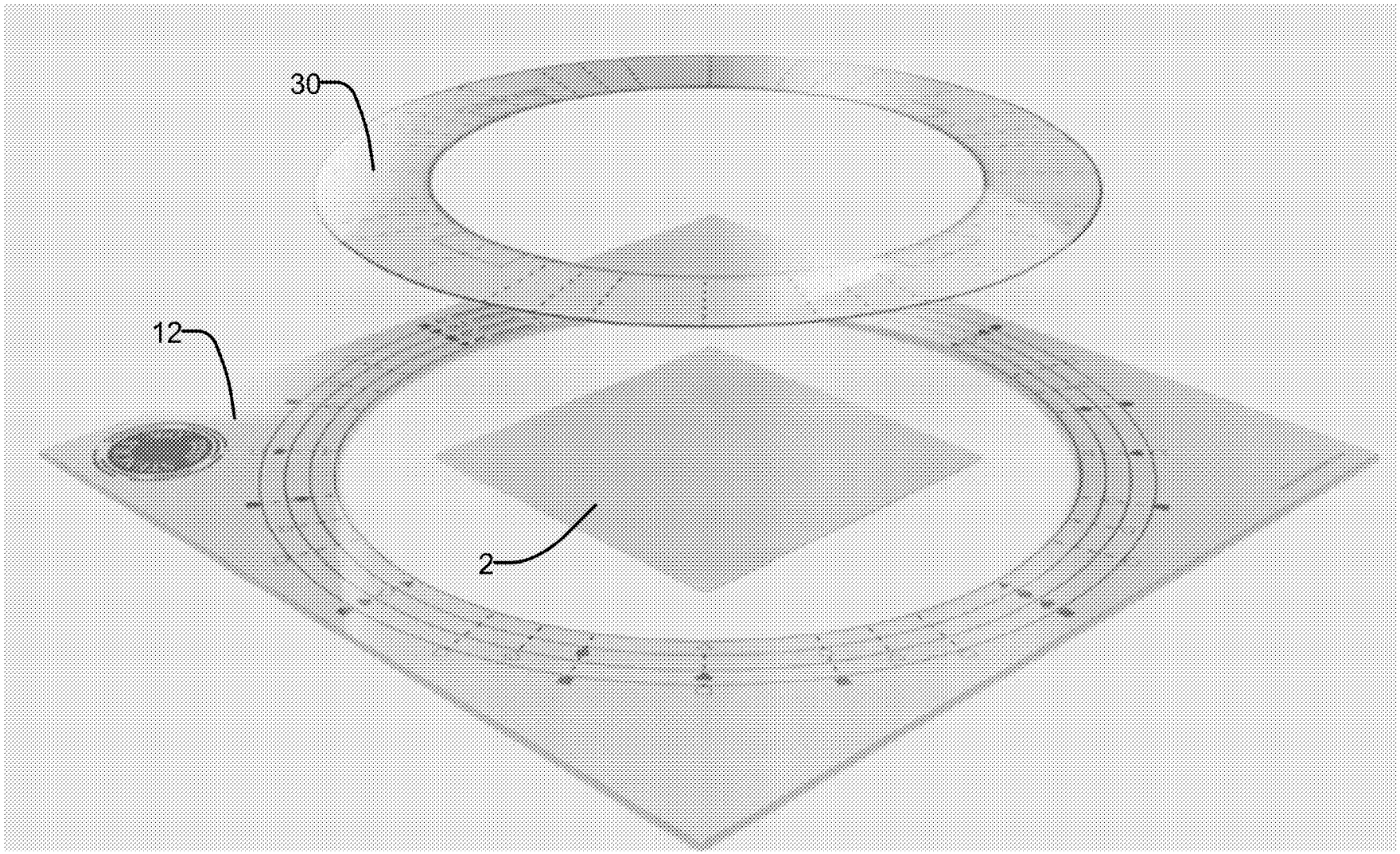
Figure 6E:
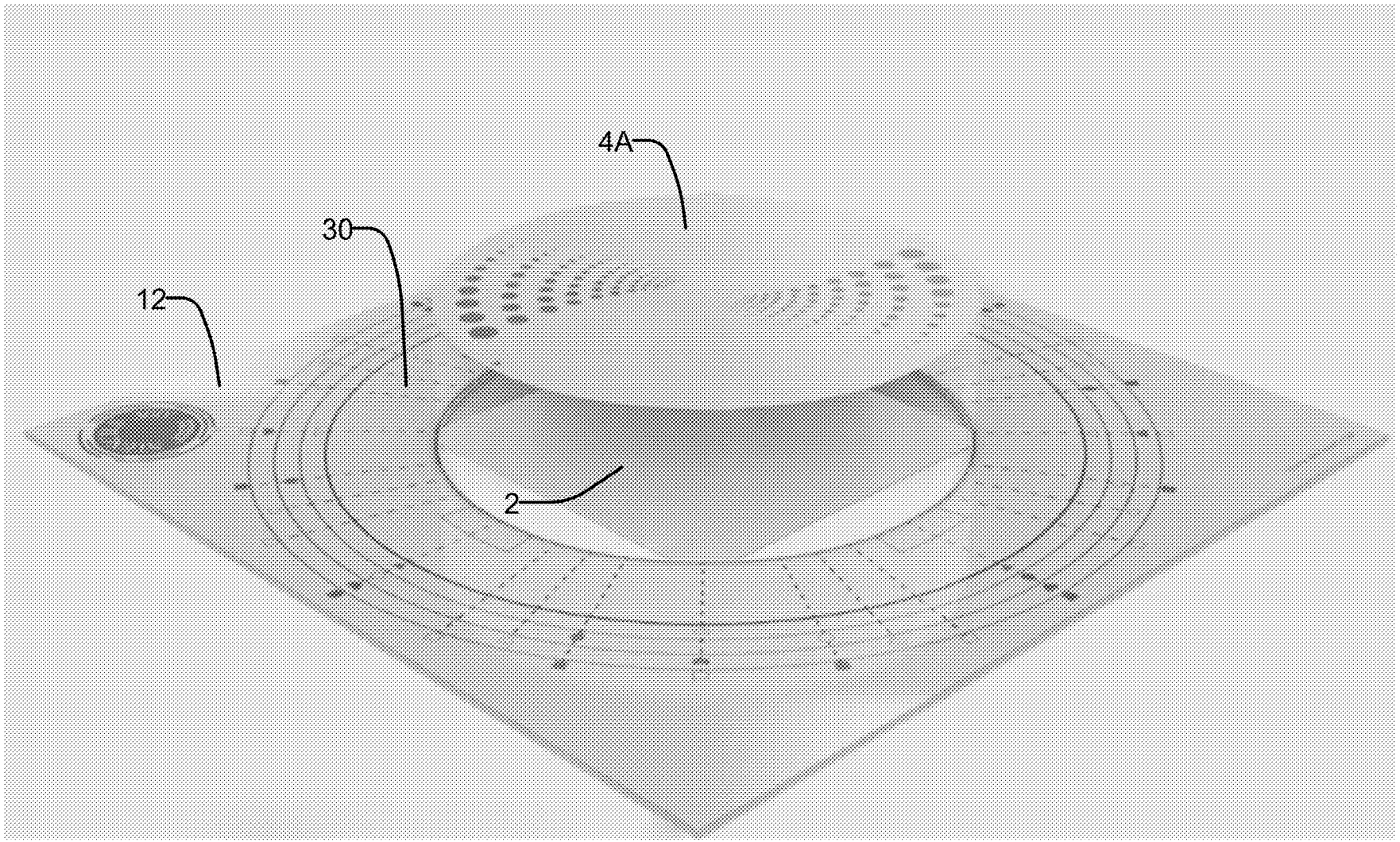
Figure 6F:
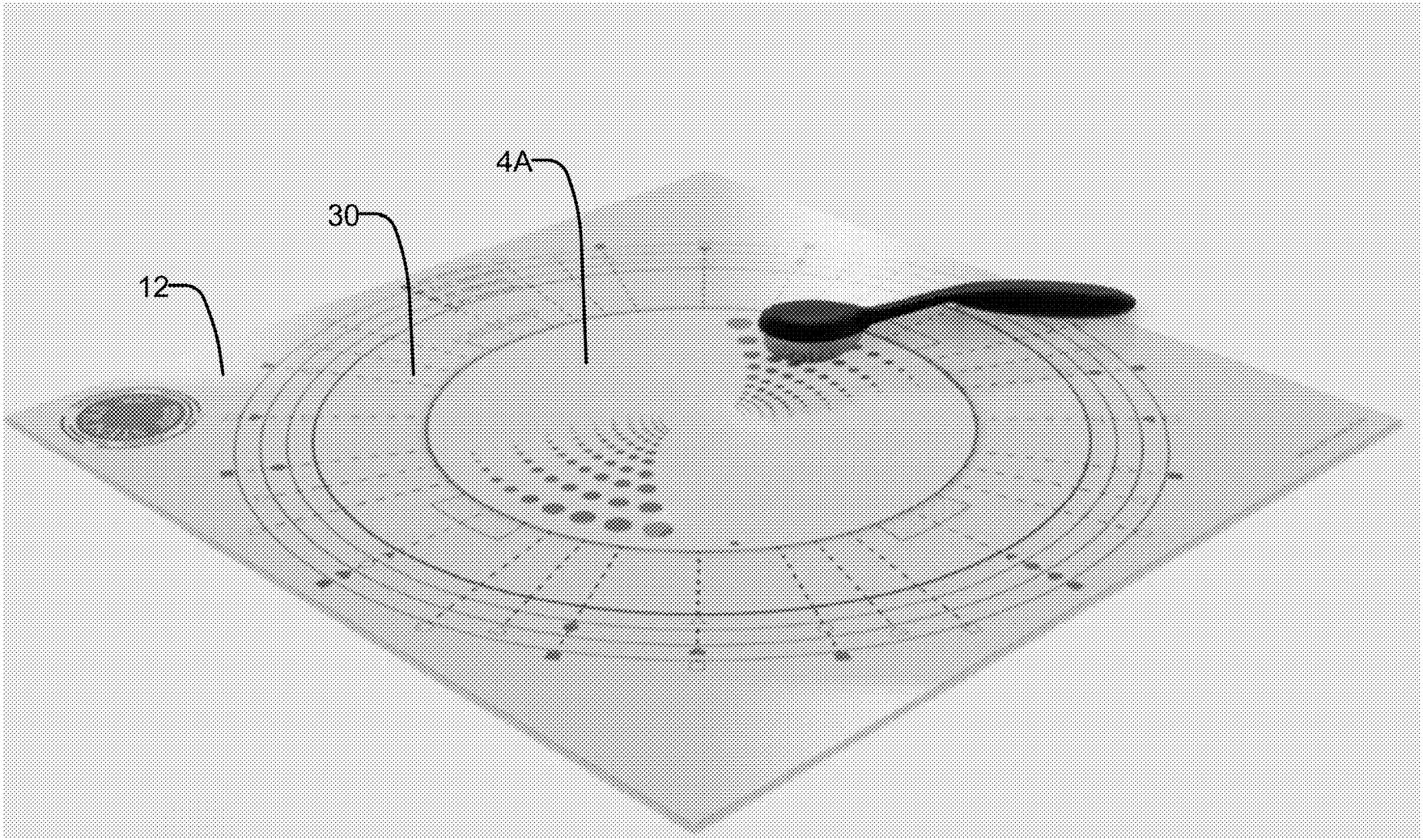

Guide ring 30 may be removably inserted in cut-out region 14 (e.g. see FIG. 6D). Guide ring 30 may be rotated (i.e. around the center of cut-out region 14) when guide ring 30 is inserted in cut-out region 14. Guide ring 30 is typically inserted in cut-out region 14 after canvas 2 has been placed (e.g. with the guidance of canvas positioner 20) and/or temporarily affixed in cut-out region 14 (e.g. see FIG. 6E). That is, guide ring 30 is typically inserted in cut-out region 14 to either partially cover or to encircle canvas 2.

Guide ring 30 comprises guide lines 35 that extend radially and are spaced circumferentially around guide ring 30. In other words, guide ring 30 comprises a radial array of guide lines 35. Guide lines 35 may be printed directly on a front surface of guide ring 30 or, preferably, on a back surface of guide ring 30. Guide lines 35 may be spaced circumferentially around guide ring 30 at angular intervals corresponding to the angular intervals A formed between circumferentially adjacent ones of scales 17. That is, guide lines 35 may be provided at locations around guide ring 30 that corresponds to the locations of scales 17 (i.e. each guide line 35 may be aligned with a corresponding line 19 or scale 17 of stencil base 12 when guide ring 30 is inserted in cut-out region 14). Guide lines 35 may be dashed as shown in FIGS. 4A-C to aid in visualization.

In some embodiments, guide ring 30 comprises one or more hatched regions 36 provided to indicate suggested location(s) for placement of removable fasteners (e.g. tapes or the like) that help secure guide ring 30 to stencil base 12 or to a work surface supporting stencil base 12. For example, guide ring 30 may comprise four hatched regions 36 located at the 12 o'clock, 3 o'clock, 6 o'clock, and 9 o'clock positions as shown in FIGS. 4A-C. In some embodiments, hatched regions 36 may comprise means for coupling guide ring 30 to stencil base 12 and/or means for coupling stencil 4A to guide ring 30.

In some embodiments, guide ring 30 comprises a marker 37 printed or otherwise marked directly on guide ring 30. Although not necessary, marker 37 is typically located near the outer circumferential edge of guide ring 30. Marker 37 may be embodied as an arrow located at an end of a guide line 35 as shown in FIGS. 4A-C. Marker 37 provides a visual indicia that may be referenced by a user to rotate and orient guide ring 30 in a desired orientation within cut-out region 14 (i.e. in an orientation which aligns each of guide lines 35 of guide ring 30 with a corresponding one of lines 19 of stencil base 12).

Stencil kit 10 typically includes one or more guide rings 30. Stencil kit 10 may include guide rings 30 that have the same outer diameter 33, but different inner diameters 31 for use with different sized stencils 4A. For example, stencil kit 10 may include a first guide ring 30 having an 8" inner diameter 31A for use with a circular stencil 4A having an 8" diameter as shown in FIG. 4A, a second guide ring 30 having a 6" inner diameter 31B for use with a circular stencil 4A having a 6" diameter as shown in FIG. 4B, and a third guide ring 30 having a 4" inner diameter 31C for use with a circular stencil 4A having a 4" diameter as shown in FIG. 4C. Stencil kit 10 may include any number (e.g. 1, 2, 3, 4, 5 or 6) of guide rings 30.

Figure 5A:
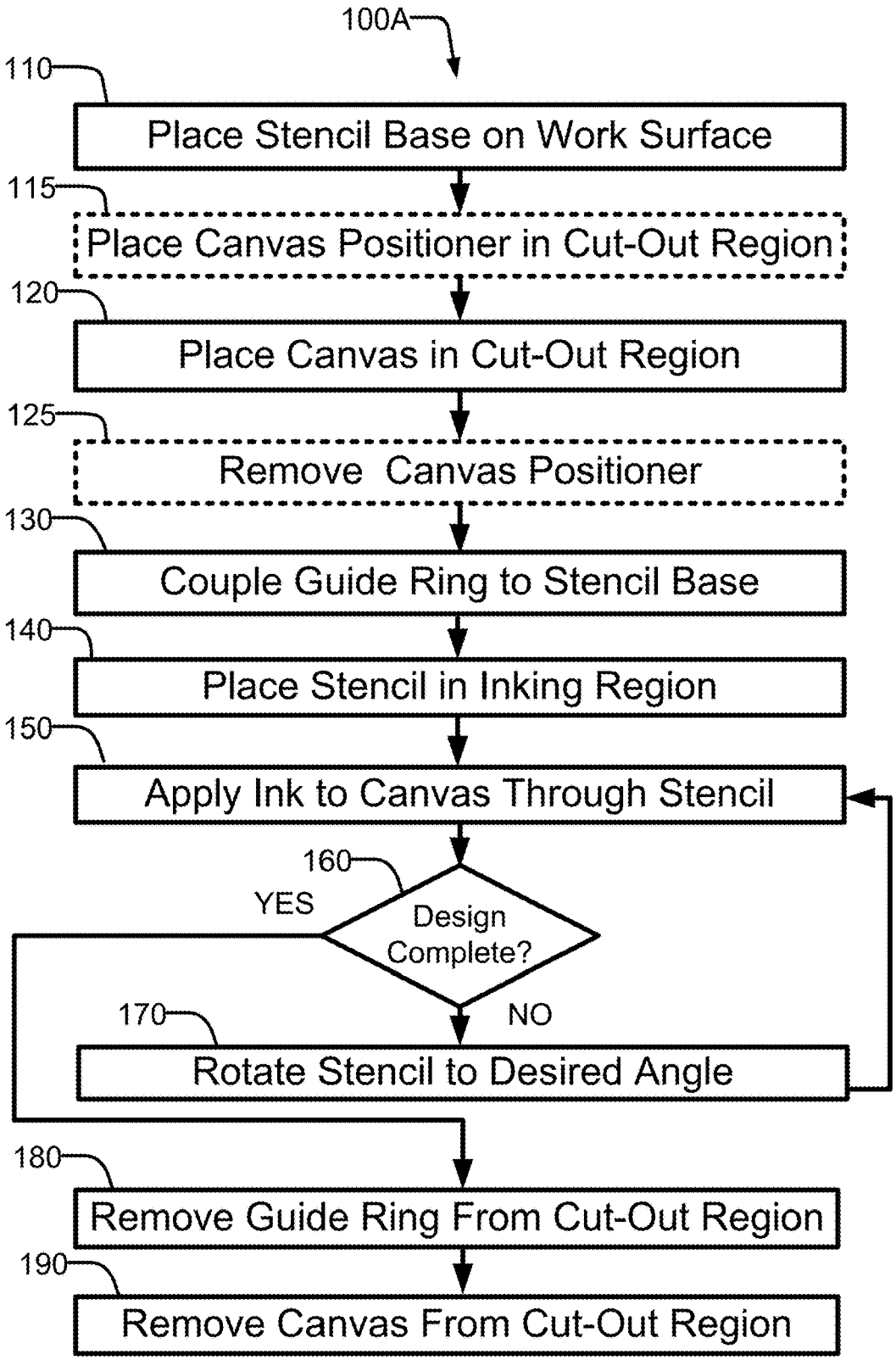
FIG. 5A is a flowchart that illustrates an exemplary method of using the FIG. 1 stencil kit with circular stencils to make patterns on a canvas.

FIG. 5A is a flowchart that illustrates a method 100A of using stencil kit 10, together with one or more stencils 4 which may be provided either as part of stencil kit 10 or separately from stencil kit 10, to make patterns and/or designs on a canvas 4. Method 100A begins with placing stencil base 12 on a work surface (e.g. a desk, a workbench, or the like) at step 110. After placing stencil base 12 on the work surface, method 100A proceeds either to optional step 115 or directly to step 120.

Optional step 115 comprises selecting a canvas positioner 20 having a suitably sized opening 22 (e.g. an opening 22 having dimensions that match the dimensions of canvas 2) and inserting the selected canvas positioner 20 in cut-out region 14. This can help guide a user position canvas 2 at a desired location (e.g. the center of cut-out region 14) within cut-out region 14 (i.e. by placing canvas 2 in opening 22 and subsequently removing canvas positioner 20 from cut-out region 14) in step 120.

Step 120 comprises positioning canvas 2 in a desired location within cut-out region 14 on the work surface. Canvas 2 may be temporarily adhered (e.g. taped, glued, etc.) to the work surface at step 120. If step 115 is performed, step 120 may also comprise rotating canvas positioner 20 after it has been inserted in cut-out region 14 to help a user orient canvas 2 in a desired orientation within cut-out region 14.

If step 115 is performed, method 100A proceeds to optional step 125 after step 120. Optional step 125 comprises removing canvas positioner 20 from cut-out region 14. For example, step 115 may comprise inserting first canvas positioner 20A having a 4¼" by 5½" opening 22 in cut-out region 14, step 120 may comprise placing a 4¼" by 5½" canvas 2 in the opening 22, and step 125 may comprise removing first canvas positioner 20A from cut-out region 14.

After positioning canvas 2 at a desired location and/or orienting canvas 2 in a desired orientation within cut-out region 14, method 100A proceeds to step 130. Step 130 comprises selecting a suitably sized guide ring 30 (i.e. a ring guide 30 having an inner diameter 31 that is about the same as the diameter of the circular stencil 4A desired to be used) and coupling the selected guide ring 30 to stencil base 12. Coupling guide ring 30 to stencil base 12 comprises inserting guide ring 30 into cut-out region 14. In some embodiments, coupling guide ring 30 to stencil base 12 further comprises rotating guide ring 30 (e.g. after it has been inserted in cut-out region 14) to align the radial array of guide lines 35 of guide ring 30 with the scales 17 of stencil base 12 and temporarily adhering (e.g. via tape) guide ring 30 to stencil base 12 or to the work surface after aligning guide lines 35 with scales 17. In other embodiments, guide ring 30 is not adhered to stencil base 12 or the work surface and is allowed to freely rotate in cut-out region 14. Guide ring 30 may encircle or partially cover canvas 2 when it is coupled to stencil base 12.

Figure 6G:
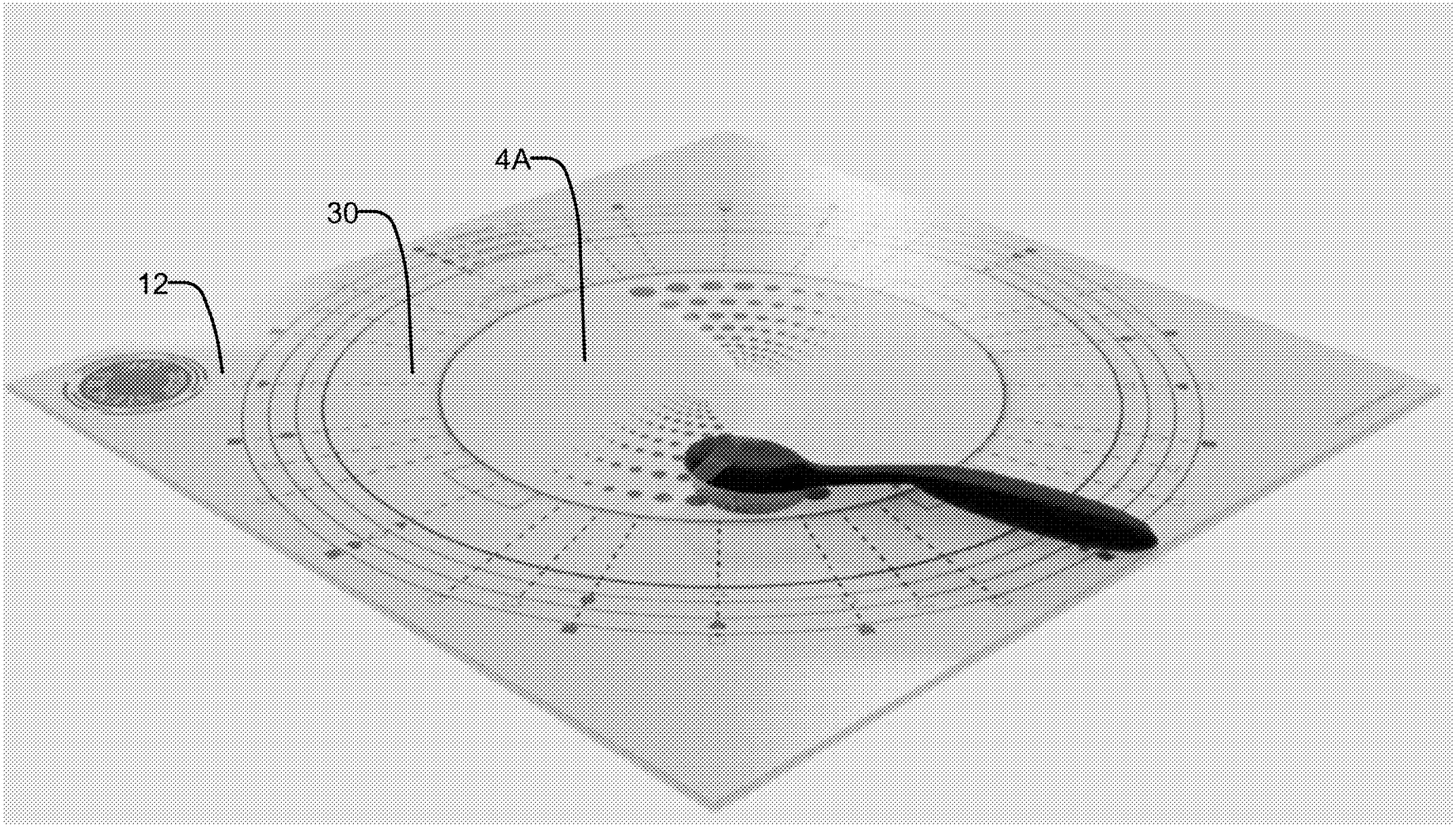

After coupling guide ring 30 to stencil base 12, method 100A proceeds to step 140. Step 140 comprises selecting a suitably sized circular shaped stencil 4A (i.e. a circular shaped stencil 4A having a diameter that is about the same as the inner diameter 31 of the guide ring 30 coupled to stencil base 12) and placing the selected stencil 4A in the inking region 32 defined by guide ring 30 (e.g. see FIG. 6G). In embodiments where guide ring 30 is allowed to freely rotate in cut-out region 14, step 140 comprises temporarily adhering stencil 4A to guide ring 30 (e.g. by taping stencil 4A to the hatched region 36 of guide ring 30). In embodiments where guide ring 30 is temporarily adhered to stencil base 12 or the work surface, stencil 4A is inserted and allowed to freely rotate in inking region 32.

After placing stencil 4A in inking region 32, method 100A proceeds to step 150. Step 150 comprises applying ink (e.g. dye ink, water-based ink) through stencil 4A to create a pattern on canvas 2. Ink may be applied by using a blending brush or an ink dabber to blend or dab the ink through stencil 4A onto canvas 2.

After applying ink through stencil 4A in step 150, method 100A proceeds to decision step 160. If the user determines that a desired design has been created on canvas 2 at step 160, then method 100A proceeds to step 180. If the user determines that the pattern created on canvas 2 is not the final desired design, then method 100A proceeds to step 170.

Step 170 comprises rotating stencil 4A to a desired angle or orientation (i.e. an angle or orientation that is different from the current angle or orientation). In embodiments where stencil 4A is temporarily adhered to guide ring 30, step 170 comprises rotating the guide ring 30 and stencil 4A together. Stencil 4A may be rotated to a desired angle by aligning a marker 5 on stencil 4A (e.g. when stencil 4A is allowed to rotated relative to guide ring 30) or marker 37 on guide ring 30 (e.g. when stencil 4A is temporarily adhered to guide ring 30) with a scale 17 of stencil base 12. For example, step 170 may comprise rotating guide ring 30 and stencil 4A together to align marker 37 with a first scale 17A from a first set 16A located at the 3 o'clock position.

After rotating stencil 4A to a desired angle or orientation in step 170, method 100A proceeds back to inking step 150 for another round of inking. A user may determine at step 160 that a desired design has been created on canvas 2 after one or more rounds of inking, whereupon method 100A proceeds to step 180.

Step 180 comprises removing stencil 4A and guide ring 30 from cut-out region 14. After removing stencil 4A and guide ring 30 from cut-out region 14, method 100A proceeds to step 190 where canvas 2 is removed from cut-out region 14.

Advantageously method 100A allows any user (e.g. a crafter) to create beautiful patterns or designs on canvas 2 by repeating the steps of rotating stencil 4A in step 150 followed by applying ink through stencil 4A in step 160. Each repetition of step 150 may comprise rotating stencil 4A to align a marker 5 of stencil 4A (or marker 37 if stencil 4A is temporarily adhered to guide ring 30) with a scale 17 from a set 16 or a subset 16-1, 16-2. For example, method 100A may comprise repeating steps 150 and 160 four times and each repetition of step 150 may comprise rotating stencil 4A by aligning marker 37 with a scale 17 from subset 16A-1 of set 16 to thereby rotate stencil 4A by 90° for each repetition of step 150. Each repetition of step 160 may optionally comprise applying ink of a different color than the ink that was applied in the previous repetition.

Method 100A also allows a user to rotate stencil 4A consistently by certain angles (e.g. 15°, 30°, 45°, 90°, etc.)

by rotating stencil 4A to align a marker 5 of stencil 4A (or marker 37 if stencil 4A is temporarily adhered to guide ring 30) with an adjacent scale 17 from the same set 16 or subset 16-1. This enables the user to create different geometric and/or radially symmetric design on canvas 2 using only a single stencil 4A.

Advantageously, stencil kit 10 can also minimize the need for a user to clean stencils 4 during a particular work session, especially in cases where it is desirable to apply different colors through stencil 4 onto canvas 2, thereby saving the user time.

Figure 5B:
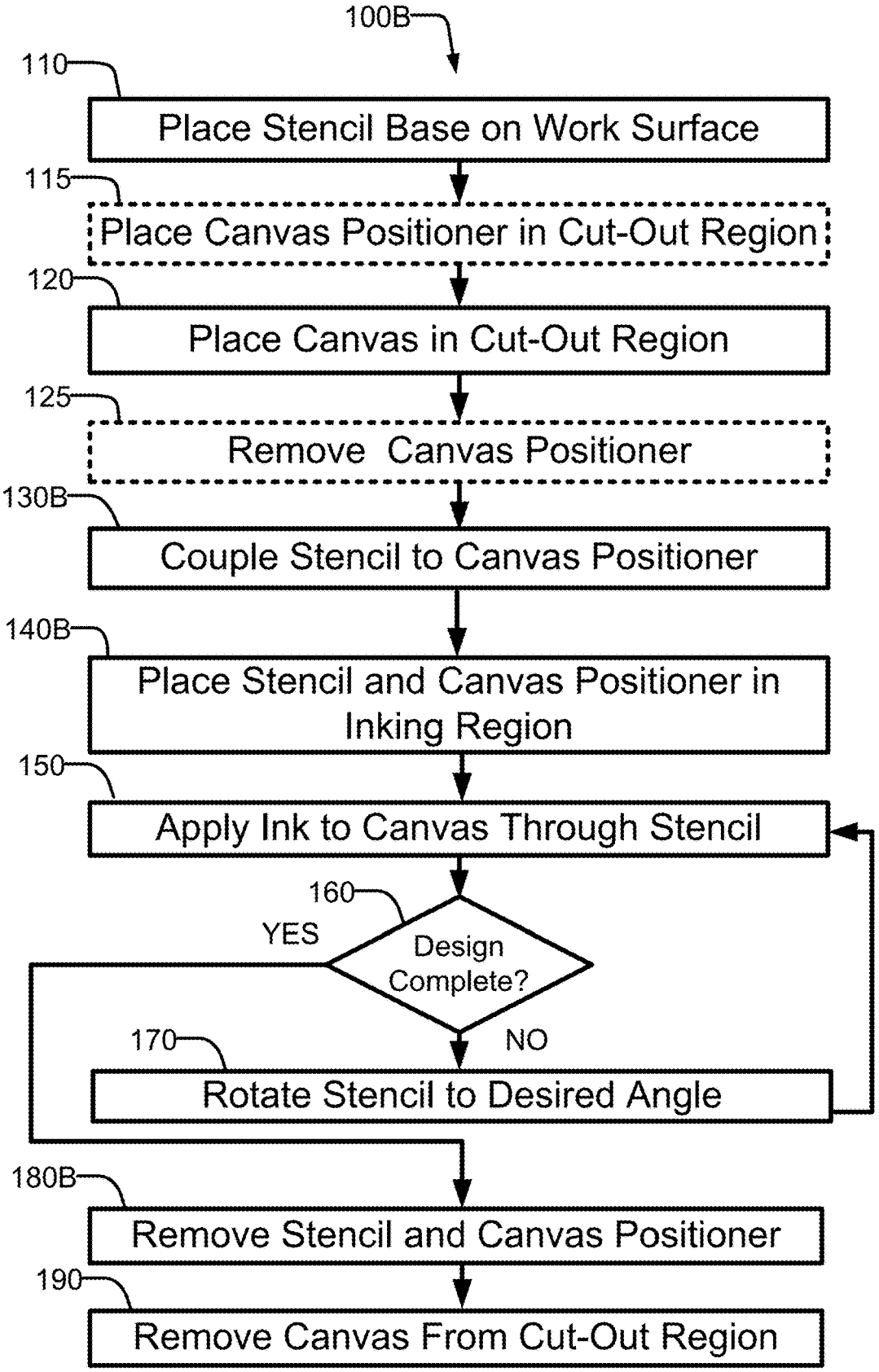
FIG. 5B is a flowchart that illustrates an exemplary method of using the FIG. 1 stencil kit with rectangular stencils to make patterns on a canvas.

FIG. 5B is a flowchart that illustrates an alternative method 100B of using stencil kit 10, together with one or more square or rectangular stencils 4B which may be provided either as part of stencil kit 10 or separately from stencil kit 10, to make patterns and/or designs on a canvas 2. Method 100B comprises placing stencil base 12 on a work surface at step 110, and positioning canvas 2 in cut-out region 14 at step 120 (and optionally with the assistance of canvas positioner 20 in steps 115). After positioning canvas 2 in cut-out region 14 at step 120 (and optionally removing canvas positioner 20 in step 125), method 100B proceeds to step 130B. Step 130B comprises temporarily coupling stencil 4B to a suitably sized canvas positioner 20 (e.g. by inserting stencil 4B in opening 22 of canvas positioner 20 and securing stencil 4B to canvas positioner 20 via tape or the like). After coupling or adhering stencil 4B to canvas positioner 20 at step 130, method 100B proceeds to step 140B. Step 140B comprises inserting canvas positioner 20 and stencil 4B in cut-out region 14 on top of canvas 2. After inserting canvas positioner 20 and stencil 4B in cut-out region, method 100B proceeds to inking step 150 and rotating step 170 to create a desired design on canvas 2. After the desired design is created on canvas 2 by repeating steps 150 and 170, method 100B proceeds to step 180B where stencil 4B and canvas positioner 20 are removed from cut-out region 14. After removing stencil 4B and canvas positioner 20, method 100A proceeds to step 190 where canvas 2 is removed from cut-out region 14.

A wide range of variations and/or supplementary features are possible within the scope of the present invention. These variations and/or supplementary features may be applied to all of the embodiments described above, as suited, and include, without limitation:

- stencil kit 10 may include stencils 4 and stencils 4 may comprise markings or markers 5 that match the symbols of scales 17 to indicate a suggested turning interval for stencil 4. For example, stencil 4 may include a triangular shaped marking (e.g. located at the 12 o'clock position of stencil 4) to indicate a suggested turning interval of 45° and to visually prompt the user to align the triangular shaped marking of stencil 4 with a triangular scale 17A from the first set 16A for each rotation in order to achieve a certain intended design of stencil 4;
- stencil kit 10 may include stencils 4 and stencils 4 may comprise markings that do not match the symbols of any of the scales 17 to indicate that the user may select their own desired turning intervals to create their own original designs;
- stencil base 12, canvas positioners 20 and/or guide rings 30 and the features thereof (e.g. cut-out region 14, opening 22, etc.) may be scaled to any suitable size or dimension;
- labels described herein (e.g. scales, symbols, sizes) may be printed on the bottom surface of stencil base 12, canvas positioners 20 and guide rings 30 to ensure that the labels can still be seen clearly even if the top surface of stencil base 12, canvas positioners 20 and guide rings 30 becomes scratched over time (e.g. due to wear and tear);
- labels described herein (e.g. scales, symbols, sizes) may be printed over a white background to ensure that the labels can be seen clearly when using stencil kit 10 with a dark work surface;
- stencil kit 10 may be adapted for use with stencils that are customized by the user (i.e. original stencils made by cutting out a portion of a cardstock using, for example, a coordinating die of a clear stamp);
- stencil kit 10 may be adapted for use with stamps in addition or in alternative to inking;
- stencil kit 10 may optionally include a brush or other tools that may be used to apply ink through stencil 4.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are consistent with the broadest interpretation of the specification as a whole.

The invention claimed is:

1. A stencil kit for enabling a user to make patterns on a canvas, the stencil kit comprising:

a stencil base having a circular shaped cut-out region and one or more sets of scales spaced circumferentially around the cut-out region;

one or more circular shaped canvas positioners having an opening for receiving the canvas, each of the canvas positioners removably insertable into the cut-out region for guiding the user to position the canvas in a desired location within the cut-out region; and one or more guide rings having a radial array of guide lines spaced circumferentially around the guide ring at angular intervals corresponding to angular intervals formed between the scales, each of the one or more guide rings removably insertable into the cut-out region to define an inking region for receiving a circular shaped stencil when the guide ring is inserted in the cut-out region.

2. The stencil kit of claim 1 further comprising the circular shaped stencil.

3. The stencil kit of claim 2 wherein the circular shaped stencil comprises a marker located at a circumferential edge of the stencil, the marker adapted for alignment with the scales when the stencil is inserted in the inking region to orient the stencil in desired orientations within the inking region.

4. The stencil kit of claim 1 wherein the stencil base comprises a first set of scales spaced circumferentially around the cut-out region at a first radial distance away from the center of the cut-out region, a second set of scales spaced circumferentially around the cut-out region at a second radial distance away from the center of the cut-out region, a third set of scales spaced circumferentially around the cut-out region at a third radial distance away from the center of the cut-out region, and a fourth set of scales spaced circumferentially around the cut-out region at a fourth radial distance away from the center of the cut-out region.

5. The stencil kit of claim 4 wherein the first set of scales comprises eight evenly spaced first scales, the second set of scales comprises twelve evenly spaced second scales, the third set of scales comprises sixteen evenly spaced third scales, and the fourth set of scales comprises twenty-four evenly spaced fourth scales.

6. The stencil kit of claim 5 wherein the first scales, the second scales, the third scales and the fourth scales are depicted by different symbols.

7. The stencil kit of claim 5 wherein the stencil base comprises first scales, second scales, third scales, and fourth scales that are located and radially aligned at the 12 o'clock, 3 o'clock, 6 o'clock and 9 o'clock positions of the stencil base.

8. The stencil kit of claim 1 wherein each of the one or more guide rings has an outer diameter that is the same as the diameter of the circular shaped cut-out region.

9. The stencil kit of claim 8 wherein the outer diameter of the guide rings is in the range of 10" to 12".

10. The stencil kit of claim 8 comprising a plurality of guide rings, wherein each of the plurality of guide rings has a different inner diameter for receiving different sized stencils.

11. The stencil kit of claim 1 wherein each of the one or more canvas positioners has an outer diameter that is the same as the diameter of the circular shaped cut-out region.

12. The stencil kit of claim 11 wherein the outer diameter of the canvas positioners is in the range of 10" to 12".

13. The stencil kit of claim 11 comprising a plurality of canvas positioners, wherein the opening of each of the canvas positioners is rectangular shaped and wherein each of the plurality of canvas positioners has a different sized opening for receiving different sized canvases.

14. The stencil kit of claim 1 wherein the stencil base, the one or more canvas positioners, and the one or more guide rings are made of polyethylene terephthalate glycol.

15. The stencil kit of claim 1 wherein the stencil base and the one or more guide rings are respectively made of transparent polyethylene terephthalate glycol and wherein the one or more sets of scales and the radial array of guidelines are respectively printed on a back surface of the stencil base over a white background.

16. A method of using the stencil kit of claim 1, the method comprising the steps of:

placing the stencil base on a work surface;

inserting a selected one of the one or more canvas positioners in the cut-out region;

placing the canvas in the opening of the selected canvas positioner and on the work surface;

removing the canvas positioner from the cut-out region;

inserting a selected one of the one or more guide rings in the cut-out region to thereby define an inking region within the cut-out region;

placing the stencil in the inking region and on top of at least part of the canvas;

rotating the stencil to a desired orientation by referencing the one or more sets of scales of the stencil base; and applying ink through the stencil to create a pattern on the canvas.

17. The method of claim 16 further comprising coupling the stencil to the guide ring, wherein rotating the stencil comprises rotating the guide ring with the stencil coupled thereto.

18. The method of claim 16 further comprising repeating the steps of rotating the stencil to a desired orientation by referencing the one or more sets of scales of the stencil base and applying ink through stencil to create a desired pattern on the canvas.

19. The method of claim 16 wherein the stencil is formed by cutting out a portion of a card stock using a coordinating die of a stamp and wherein applying ink through the stencil comprises using the stamp to imprint the pattern through the stencil.

20. A method of using the stencil kit of claim 1, the method comprising the steps of:

placing the stencil base on a work surface;

inserting a first selected one of the one or more canvas positioners in the cut-out region;

placing the canvas in the opening of the selected canvas positioner and on the work surface;

removing the canvas positioner from cut-out region;

coupling a rectangular shaped stencil to a second selected one of the one or more canvas positioners;

placing the second selected canvas positioner and the rectangular shaped stencil coupled thereto in the cut-out region to thereby position the rectangular shaped stencil on top of at least part of the canvas;

rotating the second selected canvas positioner with the stencil coupled thereto to a desired orientation by referencing the one or more sets of scales of the stencil base; and applying ink through the stencil to create a pattern on the canvas.

* * * * *